US009027192B1

(12) United States Patent
Cole

(10) Patent No.: US 9,027,192 B1
(45) Date of Patent: May 12, 2015

(54) TOOTHBRUSH WITH USAGE INDICATOR

(76) Inventor: Mandy Cole, Leesburg, VA (US)

( * ) Notice: Subject to any disclaimer, the term of this patent is extended or adjusted under 35 U.S.C. 154(b) by 470 days.

(21) Appl. No.: 10/285,617

(22) Filed: Oct. 30, 2002

(51) Int. Cl.
*A46B 13/02* (2006.01)
*A46B 15/00* (2006.01)

(52) U.S. Cl.
CPC ..... *A46B 13/02* (2013.01); *A46B 15/0004* (2013.01)

(58) Field of Classification Search
CPC ..... A46B 13/00; A46B 13/02; A46B 13/023; A46B 15/0002; A46B 15/0004; A46B 15/0038; A46B 15/0044; B08B 1/002; B08B 1/04
USPC ..... 15/167.1, 105, 21.1, 22.1; 116/306–308, 279, DIG. 1, DIG. 28; 368/107–108, 110, 113–114
See application file for complete search history.

(56) References Cited

U.S. PATENT DOCUMENTS 2,489,707 A * 11/1949 Eubanks ..... 206/361
4,208,984 A * 6/1980 Glanzman ..... 116/307
4,466,150 A * 8/1984 Jurt ..... 15/143.1
4,785,432 A * 11/1988 Havel ..... 368/82
5,119,557 A * 6/1992 Kaiko ..... 30/41.7
5,347,715 A * 9/1994 Friedland ..... 30/41.7
5,421,286 A * 6/1995 McLean ..... 116/201
5,544,382 A * 8/1996 Giuliani et al. ..... 15/22.1
5,546,624 A * 8/1996 Bock ..... 15/22.1
5,572,762 A * 11/1996 Scheiner ..... 15/105
D380,903 S * 7/1997 Moskovich ..... D4/104
5,699,900 A * 12/1997 Artis ..... 206/5.1
5,796,681 A * 8/1998 Aronzo ..... 368/10
5,801,637 A * 9/1998 Lomholt ..... 340/815.69
6,029,303 A * 2/2000 Dewan ..... 15/105
6,639,875 B2 * 10/2003 Hall ..... 368/84
6,735,802 B1 * 5/2004 Lundell et al. ..... 15/22.1
6,954,961 B2 * 10/2005 Ferber et al. ..... 15/22.1
7,832,551 B2 * 11/2010 Newman et al. ..... 206/5.1

FOREIGN PATENT DOCUMENTS

GB 2 252 234 A * 8/1992

* cited by examiner

*Primary Examiner* — Laura C Guidotti
(74) *Attorney, Agent, or Firm* — Hunton & Williams LLP

(57) ABSTRACT

This invention is a toothbrush with usage indicator for use in connection with personal dental hygiene. Most people continue to use the same toothbrush, even when it no longer provides the quality needed to maintain good dental hygiene. An old toothbrush typically has worn bristles which fail to clean the teeth and gums properly. In addition, a toothbrush that has been used for a long time tends to have a build up of bacteria on it, posing a potential health problem for the user. The toothbrush with usage indicator has particular utility in connection with knowing when it is time to replace a toothbrush, employing a battery-operated counter which turns on a red light when the toothbrush needs to be discarded. The counter is loaded with a predetermined value, for example 45, which correlates to the number of times the toothbrush should be used before being discarded. A push button on the handle of the toothbrush allows the user to decrement the counter each time the toothbrush is used. While the counter value is 4 or greater, a green light is displayed, but when the value drops below 4, a red light is displayed. The red light indicates that the toothbrush should be replaced.

10 Claims, 3 Drawing Sheets

TOOTHBRUSH WITH USAGE INDICATOR

BACKGROUND OF THE INVENTION

1. Field of the Invention

The present invention relates to a toothbrush with usage indicator for use in connection with personal dental hygiene. The toothbrush with usage indicator has particular utility in connection with knowing when it is time to replace a toothbrush. The toothbrush with usage indicator employs a battery operated counter which turns on a red light when the toothbrush needs to be discarded.

2. Description of the Prior Art

Toothbrushes are desirable for providing a means to clean teeth on an everyday basis. Most people continue to use the same toothbrush, even when it no longer provides the quality needed to maintain good dental hygiene. An old toothbrush typically has worn bristles which fail to clean the teeth and gums properly. In addition, a toothbrush that has been used for a long time tends to have a build up of bacteria on it, posing a potential health problem for the user. The "TOOTHBRUSH WITH USAGE INDICATOR" provides an easy means of detecting when a toothbrush needs to be replaced. The user simply pushes a button each time the toothbrush is used, and the color-coded alert system displays a red light when it is time to dispose of the toothbrush. Thus, the "TOOTHBRUSH WITH USAGE INDICATOR" furnishes the user with an easy way to detect the useful life of a toothbrush, thereby improving dental hygiene.

The use of a toothbrush with usage indicator is known in the prior art. For example, U.S. Pat. No. 2,489,707 to Floyd G. Eubanks discloses a toothbrush with identification means. While the Eubanks '707 patent declares a function for marking the initial use of the toothbrush to provide the user a means of judging the time for replacing the toothbrush, this function is achieved through a marker placed in a receptacle and not by the electrical means indicated in the present invention. Furthermore, the Eubanks '707 patent does not provide a mechanism for alerting the user when the toothbrush needs to be replaced, relying on the user's memory to perform this function.

U.S. Pat. No. 4,466,150 to Alfred Jurt discloses a toothbrush with indicators for when the user first uses a toothbrush and for when the user thinks the toothbrush should be replaced. Although the idea for indicating when the toothbrush needs to be replaced in the Jurt '150 patent is similar to that in the present invention, the implementation of this function is vastly different. Where the Jurt '150 patent employs a circular disc for the user to manually set the data for the beginning and ending dates of the toothbrush usage, the present invention utilizes an electrical system in which the user simply pushes a button each time the toothbrush is used and is notified when the toothbrush needs to be replaced.

Similarly, U.S. Pat. No. Des. 380,903 to Robert Moskovich discloses an ornamental design for a toothbrush with grip pads on the handle. While the Moskovich '903 patent presents a toothbrush, it makes no assertions as to a usage indicator in the toothbrush.

U.S. Pat. No. 5,421,286 to Scott McLean discloses a disposable shaver with counter and method of counting and quantitatively comparing the useful life of disposable shavers. The McLean '286 patent incorporates a series of blisters on the handle of the shaver to be depressed each time the razor is used. While the idea of counting the uses of the shaver is similar in the McLean '286 patent, the implementation is vastly different than the method used in this invention.

In addition, U.S. Pat. No. 5,347,715 to Donald H. Friedland reveals a blade shaver counter with a similar function to the toothbrush with usage indicator of the current invention. The Friedland '715 patent proposes a blade shave counter which counts the number of shaves for which the current blade has been used. However, the Friedland '715 patent differs greatly from the current invention, especially in the implementation of the control of the counting function. The Friedland '715 patent utilizes a moisture sensor to control incrementation of the counting mechanism, whereas the current invention relies on a button which the user pushes each time the toothbrush is used. Incorrect data could be fed to the counting function if the razor were accidentally knocked into the sink, left in the shower or tub area while not in use, or exposed in some other way to water while not being used for shaving.

Furthermore, U.S. Pat. No. 4,208,984 to Norman Glanzman discloses a razor usage indicator with a similar function to the current invention. Despite the similarity in function of the usage monitor, the implementation of the Glanzman '984 patent varies greatly from the present invention. The Glanzman '984 patent uses a sliding indicator in conjunction with appropriate indicia on the handle or the razor, whereas the current invention uses an electrically controlled circuit which signals the need for toothbrush replacement with a red indicator.

U.S. Pat. No. 5,119,557 to John Kaiko reveals a shave counter for use on a razor. While the Kaiko '557 patent discloses a means for keeping track of the number of uses of a particular blade, the presented embodiment is for a rotary device that is manually operated and external to the handle of the razor. The present invention utilizes a battery operated counter which is decremented by the push of a button each time the toothbrush is used.

Lastly, U.S. Pat. No. 5,544,382 to David Giuliani, Ryan W. McMahon, and David Engel, discloses a pacing toothbrush which counts the brushing time for each use. The Giuliani, et al. '382 patent does not provide for a usage monitor in the toothbrush and has the further deficiency of containing software drivers and complex internal connections for function control. While this adds attractive features to the toothbrush, it complicates the manufacturing process and considerably raises the cost of the toothbrush.

While the above-described devices fulfill their respective, particular objectives and requirements, the aforementioned patents do not describe a toothbrush with usage monitor that is electrically controlled with user input as to usage of the toothbrush. For example, the Moskovich '903 and Giuliani, et al. '382 patents do not even contain mechanisms for monitoring the usage of the toothbrushes disclosed. Eubanks '707, Jurt '150, McLean '286, Glanzman '984, and Kaiko '557 all disclose devices with a manual method for monitoring usage, whereas the current invention calls for an electrically controlled counter which is decremented, via a push button, each time the device is used. Although the Friedland '715 and Giuliani, et al. '382 patents reveal devices that are electrically operated, the Friedland '715 device relies on a moisture sensor for control of the counting function, and the Giuliani, et al. '382 device involves a complex internal structure which is cost prohibitive. Additionally, neither the Eubanks '707 patent nor the Moskovich '903 provide a means for alerting the user when the toothbrush needs to be replaced, relying on the user's memory to perform this function. Each of the aforementioned patents also contains significant structural differences to the toothbrush with usage indicator outlined in this application.

Therefore, a need exists for a new and improved toothbrush with usage indicator that runs off battery power, allows the user to confirm each use with a push button, and signals the user when the toothbrush needs to be replaced. In this regard, the present invention substantially fulfills this need. In this respect, the toothbrush with usage indicator according to the present invention substantially departs from the conventional concepts and designs of the prior art, and, in doing so, provides an apparatus primarily developed for the purpose of providing an electrical mechanism for monitoring the usage of a toothbrush.

SUMMARY OF THE INVENTION

In view of the foregoing disadvantages inherent in the known types of toothbrushes with usage indicators now present in the prior art, the present invention provides an improved toothbrush with usage indicator, and overcomes the above-mentioned disadvantages and drawbacks of the prior art. As such, the general purpose of the present invention, which will be described subsequently in greater detail, is to provide a new and improved toothbrush with usage indicator that runs off battery power, allows the user to confirm each use with a push button, and signals the user when the toothbrush needs to be replaced which has all the advantages of the prior art mentioned heretofore and many novel features that result in a toothbrush with usage indicator which is not anticipated, rendered obvious, suggested, or even implied by the prior art, either alone or in any combination thereof.

To attain this, the present invention essentially comprises a toothbrush with bristles on one end and a battery operated usage indicator located on the lower end of the handle. The usage indicator contains a counter, a numeric display, and a color indicator. The counter is initially loaded with a predetermined value equal to the number of times the toothbrush can be used before it needs to be replaced. A push button is located on the front of the toothbrush handle and is used to decrease the value in the counter each time the toothbrush is used. Upon reaching a critical value in the counter, the color indicator is enabled, signifying that the toothbrush needs to be replaced. The numeric display shows the value contained in the counter allowing the user to monitor the usage of the toothbrush.

A second embodiment of the present invention essentially comprises a toothbrush with a usage indicator that utilizes two colors to indicate when the toothbrush needs replacing. In this version of the invention, a green light is displayed when the counter is in an acceptable range, for example from 45 down to 4, and a red light is displayed as the counter approaches 0, for example from 3 down to 0. This allows time for the user to procure a replacement before disposing of the toothbrush.

A third arrangement of the present invention fundamentally comprises the usage indicator separate from the toothbrush. In this embodiment, the usage indicator comprises a counter, a numeric display, and a color indicator. As before, the counter is decremented by a push button and, upon reaching a predetermined value, enables the color indicator. The color indicator, in turn, signifies that the object has been used the predetermined amount of times. The numeric display shows the value contained in the counter, allowing the user to monitor the usage of the item to which the usage indicator is attached. The usage indicator could be attached to a toothbrush, a razor, or any other item where the user might want to monitor the number of times it has been used.

There has thus been outlined, rather broadly, the more important features of the invention in order that the detailed description thereof that follows may be better understood and in order that the present contribution to the art may be better appreciated.

The invention may also include options for the placement of the numeric display, the color indicator, and the power source receptacle and cap. Consideration has also been given to the various types of bristles available on toothbrushes, and the plethora of colors, sizes and styles of toothbrushes that are available for different users. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toothbrush with usage indicator that has all of the advantages of the prior art and none of the disadvantages.

It is another object of the present invention to provide a new and improved toothbrush with usage indicator that may be easily and efficiently manufactured and marketed.

An even further object of the present invention is to provide a new and improved toothbrush with usage indicator that has a low cost of manufacture with regard to both materials and labor, and which accordingly is then susceptible of low prices of sale to the consuming public, thereby making such a toothbrush with usage indicator economically available to the buying public.

Still another object of the present invention is to provide a new toothbrush with usage indicator that provides in the apparatuses and methods of the prior art some of the advantages thereof, while simultaneously overcoming some of the disadvantages normally associated therewith.

Even still another object of the present invention is to provide a toothbrush with usage indicator that notifies the user when it is time to replace the toothbrush. This furnishes the user with an easy way to detect the useful life of a toothbrush, thereby improving dental hygiene.

Yet another object of the present invention is to provide a toothbrush with usage indicator that provides a numeric display. This display makes it possible to monitor the exact number of times the toothbrush has been used, which could be very helpful to parents who want to verify how many times children brush their teeth.

Still yet another object of the present invention is to provide a toothbrush with usage indicator that is convenient to use. The push button feature combined with the color indicator accomplishes this convenience by allowing the user to simply bush the button with each use rather than keep up with how many times a day the toothbrush is used. The color indicator provides a simple eye-catching method of alerting the user that the toothbrush needs to be replaced.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
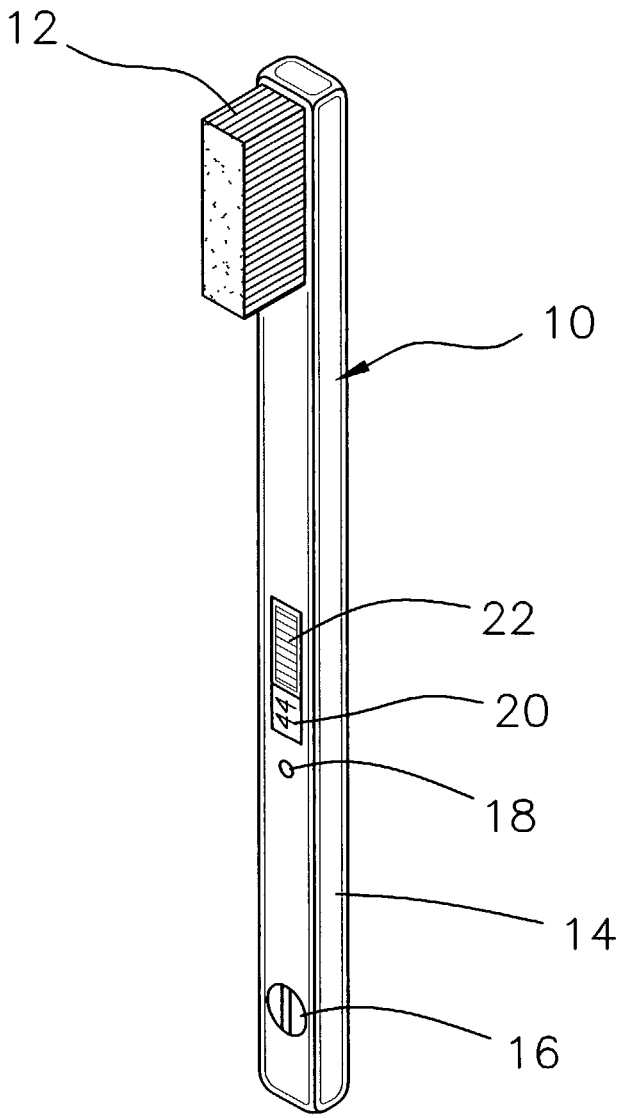
FIG. 1 is a front perspective view of the preferred embodiment of the toothbrush with usage indicator.

Referring now to the drawings, and particularly to FIGS. 1-4, a preferred embodiment of the toothbrush with usage indicator of the present invention is shown and generally designated by the reference numeral 10.

In FIG. 1, a new and improved toothbrush with a usage indicator is illustrated and will be described. More particularly, the toothbrush with usage indicator 10 is shown with the bristles 12 at the top end. The toothbrush handle 14 is displayed in a vertical position with the bristles 12 at the top and the battery access 16 at the bottom. The battery access 16 could be a plastic cap which can be removed when it is rotated 90 degrees from the locked position in which it is shown. This cap could be made of any material such as plastic or rubber that is sturdy enough to perform this function. The activation button 18 is shown approximately one third of the way up the handle 14 and is used to help control the counting function, as will be discussed further in FIG. 4. FIG. 1 also includes a numerical display 20 and a color indicator 22 on the face of the handle 14. The numerical display 20 is decremented by a single unit for each use of the toothbrush 10 and indicates how many uses the toothbrush 10 has left before recommended replacement. The color indicator 22 appears green while the display 20 decreases from 45 to 4, at which time the color then changes to red while the display 20 decreases from 3 to 0. These values are preset numbers and could be changed upon further evaluation. Changing the color indicator 22 from green to red prior to the numerical display 20 holding a value of 0 allows the user adequate time to have a replacement toothbrush available.

Figure 2:
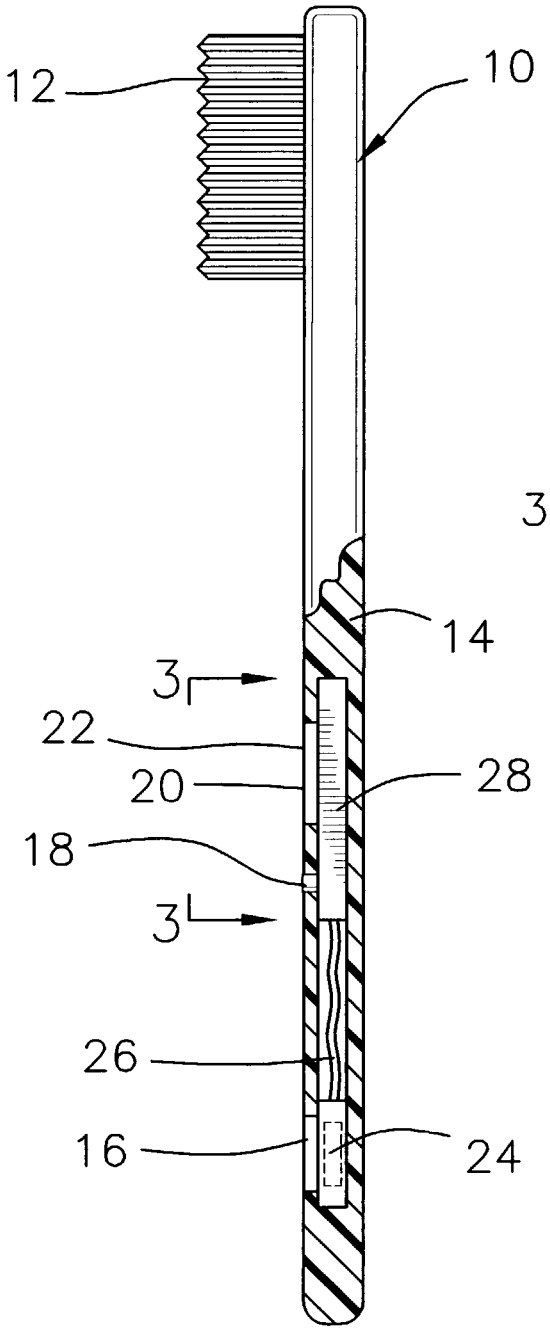
FIG. 2 is a right side view of the toothbrush with a cross section of the lower portion of the handle showing the internal connections of the usage indicator.

FIG. 2 depicts the right side of the toothbrush 10 with a cross section of the lower half of the handle 14. Once again, the toothbrush 10 is positioned with the bristles 12 at the top and the battery access 16 at the bottom. The battery access 16 is shown permitting access to the watch-size battery 24. The battery 24 is then connected via the internal wiring 26 to the counter 28. The counter 28 is decremented by the activation button 18. The counter 28 is responsible for relaying the count to the numerical display 20 and for controlling which color is displayed on the color indicator 22.

Figure 3:
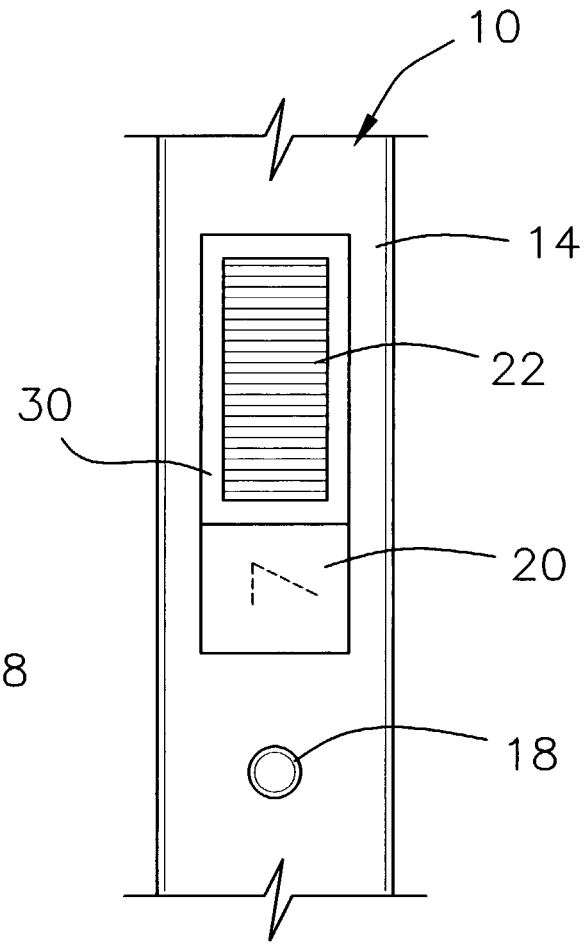
FIG. 3 is an enlarged front view of the usage indicator portion of the toothbrush handle.

FIG. 3 shows an enlarged front view of the middle section of the toothbrush handle 14. The numeric display 20 is shown to be housed in the usage indicator unit 30 with the color indicator 22. The position of the activation button 18 is also shown as it relates to the usage indicator unit 30.

Figure 4:
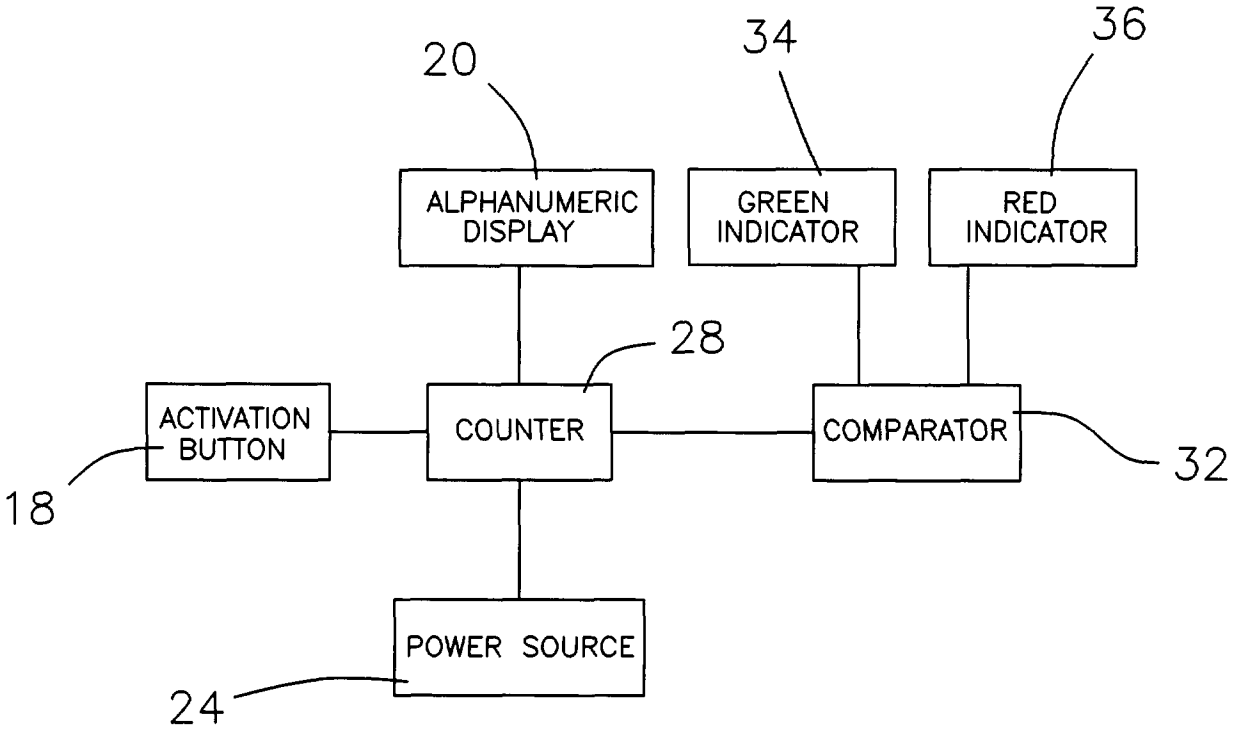
FIG. 4 is a block diagram showing the connections between the elements of the usage indicator.

FIG. 4 is a functional block diagram which indicates the functional connections of the elements of the usage indicator unit 30 of FIG. 3. The power source is the battery 24 which supplies electrical power to the usage indicator unit 30. The counter 28 is preset to value of 45 when the battery 24 is placed in the toothbrush 10. The counter 28 proceeds to pass this value to the numerical display 20 and to a comparator 32. The comparator decides whether the value is greater than 3, enabling the green indicator 34 if it is and the red indicator 36 if it is not. The green indicator 34 and the red indicator 36 are both components of the color indicator 22 of the previous FIGS. 1-3. Again, the preset values could be adjusted upon further evaluation.

While a preferred embodiment of the toothbrush with usage indicator has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable flexible material such as plastic, rubber or a variety of similar materials may be used in constructing both the toothbrush and the battery access cap. And although the primary purpose of monitoring the usage of a toothbrush is to determine when it needs to be replaced has been described, it should be appreciated that the usage monitor could be adapted for use on other objects, such as razors. The toothbrush with usage indicator herein described is also suitable for parental monitoring of whether or not children have brushed their teeth. Furthermore, the toothbrush can be manufactured in a plethora of styles, sizes, and colors, as well as with soft, medium, or firm bristles to satisfy a wide variety of users.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothbrush comprising:

a brush head;

a handle having two ends and four faces, a front face, a back face, and two side faces, and connected to said brush head at one end;

a usage indicator connected to said handle, wherein said usage indicator comprises:

a counter connected to said electric power source that stores a number of uses of said toothbrush;

a push button connected to said counter for the purpose of decrementing said counter by decrementing the number of uses; and a display to display a quantity denoting the number of uses of said toothbrush remaining until said brush heads will be worn out and require replacement; and a color indicator comprising:

a comparator connected to said counter;

a red indicator connected to said comparator; and a green indicator connected to said comparator;

wherein said comparator enables said red indicator when said counter contains a value falling within a first preset range of values and enables said green indicator when said green counter contains a value falling within a second preset range of values; and an electric power source that supplies electric power to said usage indicator.

2. The toothbrush of claim 1 wherein said brush comprises a plurality of bristles.

3. The toothbrush of claim 1, wherein said handle further comprises:

a power source receptacle that houses said power source.

4. The toothbrush of claim 3 wherein said power source receptacle further comprises:

a cap that secures said electric power source in said power source receptacle.

5. The toothbrush of claim 4 wherein said power source receptacle and said cap are adapted for a notched coupling.

6. The toothbrush of claim 4 wherein said cap resides on said front face of said handle.

7. The toothbrush of claim 4 wherein said power source receptacle and said cap house a watch battery.

8. The toothbrush of claim 1, wherein said display resides on said front face of said handle.

9. The toothbrush of claim 1, wherein said red indicator comprises a red light emitting diode.

10. The toothbrush of claim 1, wherein said green indicator comprises a green light emitting diode.

* * * * *